US009234432B2

(12) United States Patent
Shinoda et al.

(10) Patent No.: US 9,234,432 B2
(45) Date of Patent: Jan. 12, 2016

(54) GAS TURBINE AND TURBINE STATIONARY BLADE FOR SAME

(75) Inventors: Yuji Shinoda, Kobe (JP); Tomoki Taniguchi, Kobe (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 552 days.

(21) Appl. No.: 13/641,063

(22) PCT Filed: Apr. 11, 2011

(86) PCT No.: PCT/JP2011/058997

§ 371 (c)(1),
(2), (4) Date: Oct. 12, 2012

(87) PCT Pub. No.: WO2011/129298

PCT Pub. Date: Oct. 20, 2011

(65) Prior Publication Data

US 2013/0028727 A1 Jan. 31, 2013

(30) Foreign Application Priority Data

Apr. 15, 2010 (JP) ..... 2010-093666

(51) Int. Cl.
*F01D 25/12* (2006.01)
*F01D 9/06* (2006.01)
*F01D 9/02* (2006.01)

(52) U.S. Cl.
CPC *F01D 9/065* (2013.01); *F01D 9/02* (2013.01); *F05D 2250/185* (2013.01); *F05D 2260/20* (2013.01); *F05D 2260/201* (2013.01)

(58) Field of Classification Search
CPC ..... F01D 9/02; F01D 9/065
USPC ..... 415/115, 116; 416/97 R
See application file for complete search history.

(56) References Cited

U.S. PATENT DOCUMENTS 5,207,556 A 5/1993 Frederick et al.
5,645,397 A 7/1997 Soechting et al.

(Continued)

FOREIGN PATENT DOCUMENTS

JP 60-022003 A 2/1985
JP 06-010704 A 1/1994

(Continued)

OTHER PUBLICATIONS

The extended European search report issued by the European Patent Office on Jun. 26, 2014, which corresponds to EP11768819.2-1610 and is related to U.S. Appl. No. 13/641,063.
International Search Report; PCT/JP2011/058997; Jun. 14, 2011.

*Primary Examiner* — Igor Kershteyn
*Assistant Examiner* — Woody A Lee, Jr.
(74) *Attorney, Agent, or Firm* — Studebaker & Brackett PC

(57) ABSTRACT

A gas turbine engine and a turbine stator assembly which is capable of being cooled effectively with a small amount of air. The stator assembly comprises a stator vane disposed to be exposed to a combustion gas passage. The stator vane comprises a cooling passage defined therein. The cooling passage is disposed on an upstream of the gas turbine engine and extending in a radial direction with respect to a central axis of the gas turbine engine. The stator vane also has an inlet communicated to a radially outward end of the cooling passage. The stator vane further has an adjustment member secured to the stator vane so that it covers the inlet. The adjustment member has two apertures for guiding a cooling air radially inwardly through the inlet into the cooling passage. The two apertures are spaced away from each other along a camber line of the stator vane.

2 Claims, 3 Drawing Sheets

(56) References Cited

U.S. PATENT DOCUMENTS

| | | | | |
|---|---|---|---|---|
| 6,398,486 | B1 * | 6/2002 | Storey et al. | 415/115 |
| 6,561,757 | B2 * | 5/2003 | Burdgick et al. | 415/115 |
| 7,445,432 | B2 * | 11/2008 | Levine et al. | 416/96 R |
| 2003/0170113 | A1 * | 9/2003 | Burdgick et al. | 415/1 |
| 2004/0258516 | A1 * | 12/2004 | Beverley et al. | 415/115 |
| 2011/0085894 | A1 | 4/2011 | Dueckershoff et al. | |

FOREIGN PATENT DOCUMENTS

| | | | |
|---|---|---|---|
| JP | 09-112205 | A | 4/1997 |
| JP | 2002-004803 | A | 1/2002 |
| JP | 2003-286805 | A | 10/2003 |
| JP | 2005-009496 | A | 1/2005 |
| WO | 2009/153108 | A2 | 12/2009 |

* cited by examiner

GAS TURBINE AND TURBINE STATIONARY BLADE FOR SAME

TECHNICAL FIELD

The present invention relates to a gas turbine engine and stator assembly for use therein. In particular, the present invention relates to air-cooled stator assembly.

BACKGROUND OF THE INVENTION

Typically, the stator vanes of the gas turbine stator assembly for use in the gas turbine engine each comprise an air-cooling mechanism for increasing a heat resistance of its blades exposed to high-temperature combustion gas generated by the combustors. The mechanism comprises a cooling cavity or passage defined within each blade into which a compressed air from the compressor is introduced for the cooling of the blade. According to this mechanism, an increase of the cooling air consumed for the blade cooling results in a decrease in efficiency of the gas turbine engine. This needs the blade to be effectively cooled with a minimum amount of air. Typically, however, the stator vane is manufactured by molding and therefore it is relatively difficult to form small inlets for introducing small amount of cooling air into the passage of the blade. To solve this problem, JP 2003-286805 (A) discloses another cooling mechanism in which a flow-rate control plate with a number of small apertures is used as a member to be inserted in the air passage within the stator vane in order to effectively cool the stator vane with a limited amount of air. This mechanism needs the insert member and therefore results in a structural complexity and a cost increase.

An alternative may be, as shown in FIG. 5, to place a plate 54 with a small aperture 58 defined therein so that it covers the inlet 53 of the cooling passage 52 defined within each blade 51 of the stator assembly 50 to restrict the amount of air to be supplied into the passage. This arrangement may ensure that only a limited amount of air A be introduced into the cooling passage 52 through the aperture 58 and the inlet 53. Disadvantageously, a numerical analysis conducted by the inventors revealed that the flow of air A entering through the inlet 53 advanced obliquely to cause air stagnation zones S1 and S2 in the front and rear sides of the flow, adjacent the inlet 53. In particular, the front stagnation zone was formed immediately behind the front the wall portions where the high-temperature combustion gas G would hit directly and therefore deemed to be the most needed for cooling, which failed the blade 51 to be cooled effectively.

SUMMARY OF THE INVENTION

An object of the invention is to provide a stator assembly with a mechanism for effectively cooling the entirety of the blades using a limited amount of air and a gas turbine engine having the stator vanes.

To this end, a turbine stator assembly comprises a stator vane disposed to be exposed to a combustion gas passage. The stator vane comprises a cooling passage defined therein. The cooling passage is disposed on an upstream of the gas turbine engine and extends in a radial direction with respect to a central axis of the gas turbine engine. The stator vane also has an inlet communicated to a radially outward end of the cooling passage. The stator vane further has an adjustment member secured to the stator vane so that it covers the inlet. The adjustment member has two apertures for guiding a cooling air radially inwardly through the inlet into the cooling passage. The two apertures are spaced away from each other along a camber line of the stator vane.

According to the stator vane, the cooling air is introduced into the cooling passage through the two apertures spaced away from each other along the camber line and then through the inlet. This prevents the cooling air from flowing only the central portion of the cooling passage which would be caused where the cooling air is introduced the cooling passage through a single aperture. Then, no deviated flow of the cooling air would cause in the cooling passage. Also, the cooling air flows evenly in the cooling passage. As a result, the turbine stator assembly, in particular the upstream end thereof is effectively cooled. Further, the opening area of the two apertures is determined so that a necessary amount of cooling air flows into the apertures. This ensures that the gas turbine engine is efficiently operated with an elevated cooling effect by using only a minimum amount of cooling air.

In another aspect of the invention, the inlet is elongated along the camber line. The inlet has a length L along the camber line. One of the two apertures disposed on the upstream side has a central axis which is positioned L/4 to L/3 away from an upstream end of the inlet. The other of the two apertures disposed on the downstream side has a central axis which is positioned 2L/3 to 3L/4 away from the upstream end of the inlet. According to this embodiment, the two aperture arrangement allows that the cooling air is passed through the inlet in its entirety at an even velocity into the cooling passage. In particular, because one of the aperture is positioned L/4 to L/3 away from the upstream end of the inlet, a large amount of air flows in the vicinity of the front wall of the stator vane for its effective cooling where it is required to be cooled more than other places.

In another aspect of the invention, the two apertures have a circular cross section having a certain diameter. In this instance, the adjustment plate can be manufactured simply using a single drilling machine and repeating two drilling processes.

In another aspect of the invention, the stator vane has a radially outward flange in which the inlet is formed and the adjustment member is secured on an outward surface of the flange. In this instance, the adjustment plate can be firmly secured to the flange by the simple fixing means such as welding.

With the stator vane and the gas turbine engine according to the invention, the cooling air is introduced in a dispersed manner through two apertures spaced away from each other along the camber line and through the inlet into the cooling passage. This prevents the introduced cooling air from passing only the central region of the cooling passage and also prevents a deviation of the cooling air flow in the cooling passage. This ensures an even flow of cooling air in the cooling passage and, as a result, an effective cooling of the front wall of the stator vane. Also, the opening area of the two apertures is determined so that the gas turbine engine is efficiently operated with an elevated cooling effect using only a minimum amount of cooling air.

BRIEF DESCRIPTIONS OF THE DRAWINGS

PREFERRED EMBODIMENT OF THE INVENTION

Figure 1:
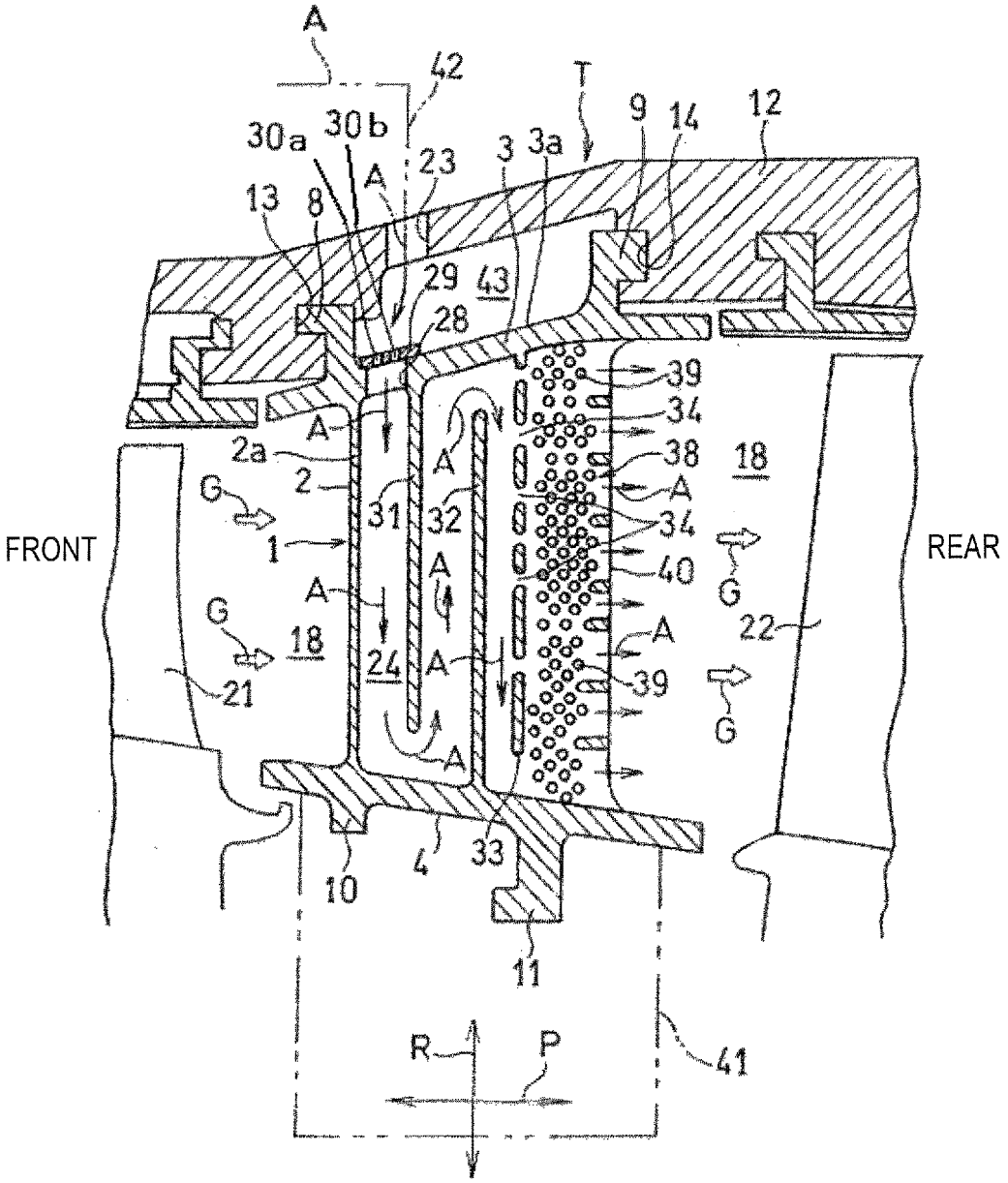
FIG. 1 is a partial cross section of a gas turbine engine in accordance with an embodiment of the invention.

With reference to the accompanying drawings, a preferred embodiment according to the invention will be described below. A gas turbine engine comprises a compressor for compressing air, combustors for combusting a mixture of fuel and compressed air from the compressor and a turbine to be driven by high-temperature and high-pressure combustion gas from the combustors. As shown in FIG. 1, the turbine T comprises stator assemblies 1 and rotor assemblies 21, 22 positioned alternately in a direction P parallel to the central axis of the gas turbine engine, or rotational axis of the rotor. Typically, each rotor assembly is positioned behind the associated stator assembly.

Figure 2:
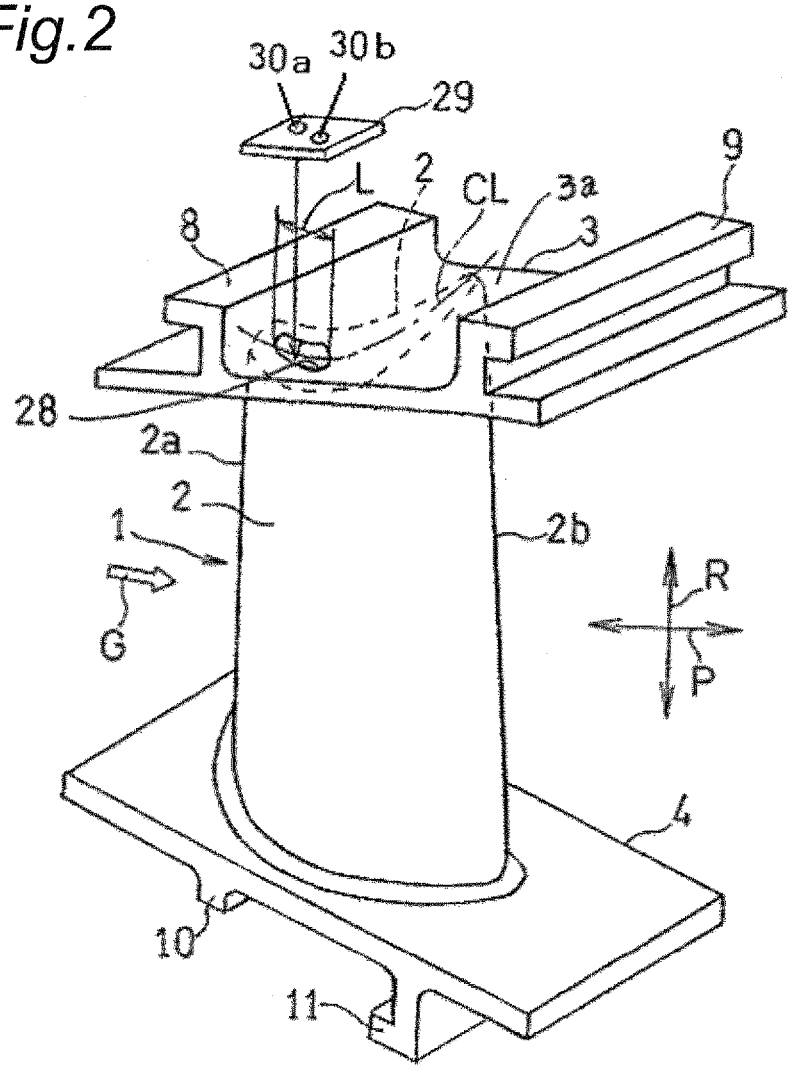
FIG. 2 is a perspective view of a stator vane shown in FIG. 1.

As shown in FIG. 2, the stator assembly 1 comprises a number of stator vanes 2 each having an outer flange 3 and an inner flange 4 integrally formed therewith at the radially outward and inward ends of the blade. Typically, the blade 2 is molded by using molds. The outer flange 3 comprises outer engagement portions 8 and 9 formed integrally therewith on front and rear sides with respect to the axial direction P. The inner flange 4 comprises inner projection 10 and engagement portion 11 formed integrally therewith on the front and rear sides with respect to the axial direction P.

As shown in FIG. 1, the stator vane 1 so constructed is supported by the turbine casing 12 with the engagement portions 8 and 9 of the outer flange 3 slidingly engaging in a circumferential direction with complementary engagement portions 13 and 14 of the turbine casing 12, in which the stator vane 2 is exposed in a passage 18 guiding the high-temperature combustion gas. The inner projection 10 and the inner engagement portion 11 of the inner flange 4 are engaged with complementary portions defined in the inner ring 41 positioned radially inward of the stator vanes.

Referring back to FIG. 1, the turbine casing 12 comprises an air supply chamber 43, an air extraction passage 42 and air inlets 23 defined therein for supplying a certain amount of compressed air A from the compressor therethrough to the stator vanes 2. The stator vanes 2 each have a cooling passage 24 or cavity integrally defined therein and divided by two radially extending partitions 31 and 32. In the embodiment, the cooling passage comprises three passage portions extending substantially parallel to the front wall 2*a*. The first passage portion adjacent the front wall 2*a* is communicated with the second passage portion immediately behind the first passage portion through a communication path defined at a radially inward end of the partition 31. The second passage portion is communicated with the third passage portion immediately behind the second passage portion through a communication path defined at a radially outward end of the partition 32. The outer flange 3 comprises an inlet 28 for introducing the cooling air A into the cooling passage 24 defined at a portion of the flange positioned inside the air inlet 23. The inlet 28 is positioned in the vicinity of the front wall 2*a* and is communicated to the upstream end of the cooling passage 24. The air supply chamber 43 accommodates a plate 29 for adjusting an amount of cooling air to be supplied into the cooling passage. As shown in the drawing, the adjustment plate 29 is secured on the outer surface 3*a* of the outer flange 3 to cover the inlet 28. The adjustment plate 29 has two apertures 30*a* and 30*b* for introducing the cooling air A into the cooling passage 24 through the inlet 28.

The blade 2 is also designed so that the cooling air A passed through the cooling passage 24 flows through openings 34 or gaps defined between the guide walls 33 spaced away from each other in the radial direction R into another cooling passage 38 in which the cooling air deprives of heat from a number of pin fins 39 formed integrally with the blade 2 for the cooling of the blade 2. The cooling air is then discharged through outlet openings 40 defined in the rear wall 2*b* of the blade 2 into the combustion gas passage 18. The pin fins 39 may be eliminated.

As shown in FIG. 2, the passage inlet 28 is formed in the outer flange 3 in the vicinity of the front wall 2*a* and is elongated along a camber line CL when viewed from radially inwardly. The camber line CL is the line formed by the points halfway between the front and rear surfaces of the blade 2. The adjustment plate 29 with two apertures 30*a* and 30*b* is securely welded to the outer surface 3*a* of the outer flange 3 to cover the inlet 28. The apertures 30*a* and 30*b* of the adjustment plate 29 are circular through-holes having the same size and shape, for example. The sizes and the shapes of the apertures 30*a* and 30*b* are determined so that a certain amount of cooling air A is introduced into the cooling passage 24 through the apertures 30*a* and 30*b*.

Figure 3:
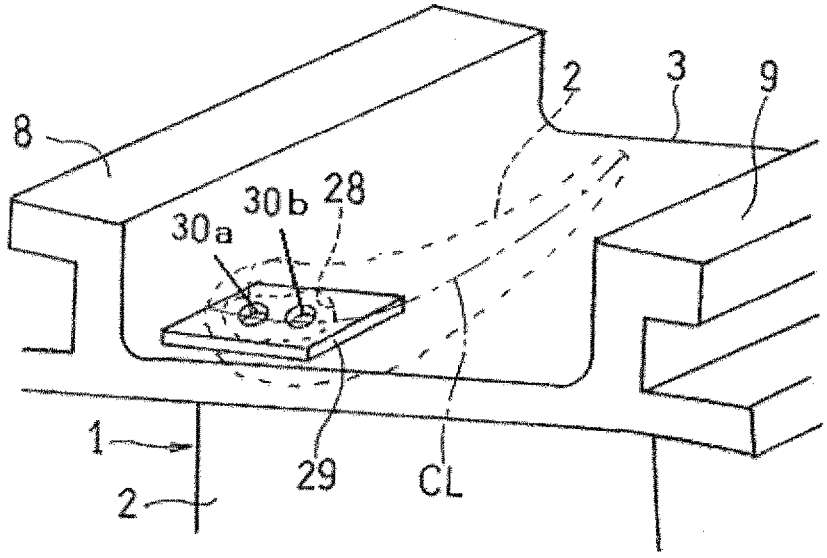
FIG. 3 is a partial perspective view of the stator vane shown in FIG. 1.
Figure 4:
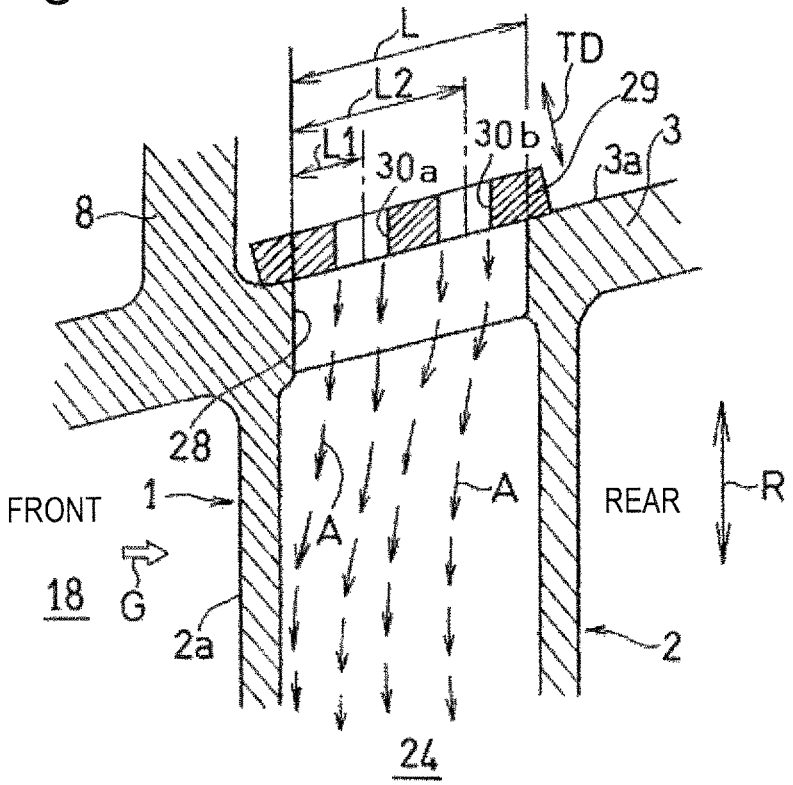
FIG. 4 is a partial cross section of the stator vane in FIG. 1.

As shown in FIG. 3, the adjustment plate 29 is secured to the outer flange 3 with the apertures 30*a* and 30*b* opposed to and communicated with the inlet 28 and with the centers of the apertures substantially positioned on the camber line CL. Referring to FIG. 4 in detail, the inlet 28 has a length L (see FIG. 2) along the camber line CL. The center of the front aperture 30*a* on the left in FIG. 3 is positioned a distance L1 away from the front end of the inlet 28 along the camber line CL. The distance L1 may range from ¼ to ⅓ of the length L. The center of the rear aperture 30*b* on the right in FIG. 3 is positioned a distance L2 away from the front end of the inlet 28 along the camber line CL. The distance L2 may range from ⅔ to ¾ of the length L.

Figure 5:
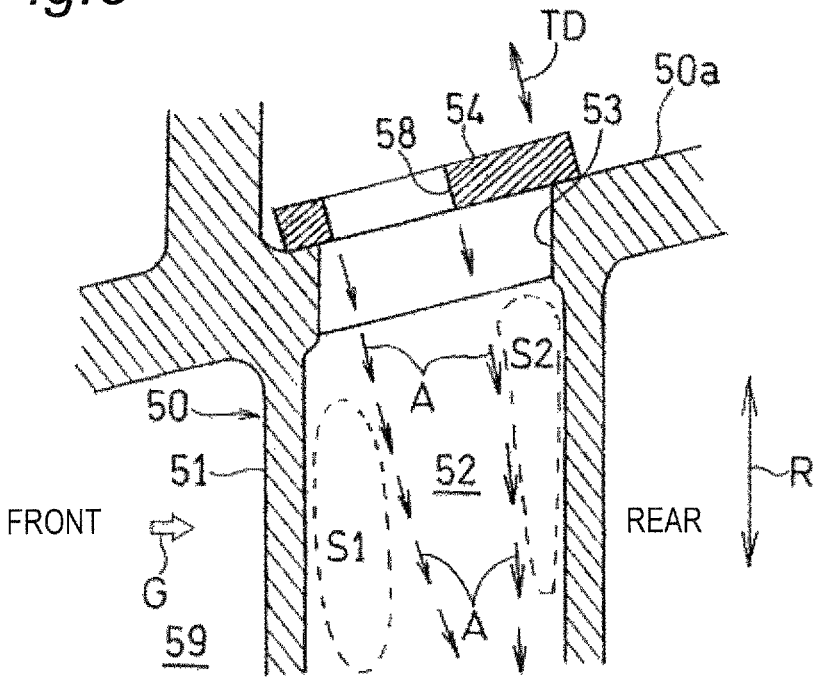
FIG. 5 is a partial cross section of a stator vane.

As shown in FIGS. 1, 4 and 5, the radially outward surface (indicated at 50*a* in FIG. 5, for example) of the blade is inversely tapered in the rearward direction in a region of the combustion gas passage (indicated at 59 in FIG. 5, for example) where the diameter of the passage gradually increases rearwardly. This results in that, when assuming that the aperture 58 extends in the thicknesswise direction TD orthogonal to the surface of the plate 54, the air is guided into the cooling passage 52 through the aperture 58 so that it moves away from the front wall.

Contrarily, as shown in FIG. 4, the apertures 30*a* and 30*b* are defined so that the central axes of the apertures are directed in the radial direction R when the adjustment plate 29 is secured on the blade 2. Also, the apertures 30*a* and 30*b* are positioned on the camber line CL and spaced away from each other. This ensures that the cooling air from the apertures 30*a* and 30*b* into the cooling passage 24 is dispersed evenly in the passage 24 without forming any air stagnation zone.

Therefore, as shown in FIGS. 1 and 4, the stator vane 1 ensures that the cooling air A is introduced from the supply chamber 43 through the apertures 30*a* and 30*b* into the cooling passage 24 where it flows through the passage portions to cool the blade 2 effectively. In particular, the cooling air A is divided into two flows and guided through respective apertures 30*a* and 30*b* and the inlet 28 into the cooling passage 24. This ensures the cooling air to be dispersed evenly in the cooling passage 24 and prevents the cooling air A from flowing only the central portion of the cooling passage 24 which would be caused where the cooling air is introduced the cooling passage through a single aperture. Also, no oblique flow or air stagnation zone is generated, which ensures the effective cooling of the blade 2.

In particular, because the center of the front aperture 30*a* is positioned L/4 to L/3 away from the front end of the inlet 28 along the camber line CL and also the rear aperture 30*b* is positioned 2L/3 to 3L/4 away from the front end of the inlet 28 along the camber line CL, the cooling air A passes substantially evenly through the inlet 28 into the cooling passage 24. Also, the front aperture 30*a* is positioned forwardly and therefore a larger amount of cooling air flows in the vicinity of the front wall 2*a*, which effectively cools the front wall 2*a* exposed to high-temperature combustion gas G.

Further, the central axes of the apertures 30*a* and 30*b* are oriented in the radial direction R and therefore the cooling air is distributed evenly into the cooling passage 24 and the air flow is formed on and in the vicinity of the front wall 2*a*. Furthermore, the opening areas of the apertures 30*a* and 30*b* are determined so that a predetermined amount of cooling air is passed therethrough into the cooling passage 24, which ensures an effective cooling of the blade and minimizes a possible reduction in efficiency of the gas turbine engine due to the increase of the extraction air.

Also, according to the embodiment, because the apertures 30*a* and 30*b* have the same diameter, the adjustment plate 29 can be manufactured simply using a single drilling machine and repeating two drilling processes. Further, according to the embodiment, because the inlet 28 is formed in the outer flange 3 and the adjustment plate 29 is secured on the surface 3*a* of the flange 3, the adjustment plate 29 can be firmly secured to the flange by the simple fixing means such as welding.

Although preferred embodiments of the invention have been described with reference to the accompanying drawings, various modifications can be made without departing from the gist of the invention and they are within the scope of the invention.

PARTS LIST

1: stator assembly
2: stator vane
2*a*: front wall
3: outer flange
12: turbine casing
18: combustion gas passage
24: cooling air passage
28: inlet
29: adjustment plate
30*a*, 30*b*: aperture
A: cooling air
CL: means camber line
G: combustion gas
R: radial direction
T: turbine

The invention claimed is:

1. A stator blade supported by a turbine casing of a gas turbine engine, the gas turbine engine having a compressor for compressing air, combustors for combusting a mixture of fuel and compressed air supplied from the compressor, and a turbine to be driven by high-temperature and high-pressure combustion gas from the combustors, the turbine having stator assemblies and rotor assemblies positioned alternately in a direction parallel to a central axis of the gas turbine engine, the stator assemblies each having a number stator blades, wherein the stator blade has a single air passage defined in the stator blade, the single air passage having a portion positioned on an upstream side and extending in a radial direction of the gas turbine engine;

a single inlet defined in the stator blade to open radially outwardly in communication with the upstream portion of the single air passage;

an adjustment plate covering the single inlet, the adjustment plate having two apertures defined therein for introducing a cooling air radially inwardly into the single inlet, the two apertures being positioned and spaced away from each other on a camber line of the stator blade, the single inlet being elongated along the camber line and having a length along the camber line, one of the two apertures on the upstream side being positioned L/4 to L/3 away from an upstream end of the single inlet and the other on the downstream side being positioned 2L/3 to 3L/4 away from the upstream end of the single inlet; and a radially outward flange defined in the stator blade, the flange having the single inlet formed therewith and a radially outward surface on which the adjustment plate is fixed.

2. The stator blade of claim 1, wherein the two apertures are circular in shape having the same inner diameter.

* * * * *